US007841146B2

(12) United States Patent
Colucci et al.

(10) Patent No.: US 7,841,146 B2
(45) Date of Patent: Nov. 30, 2010

(54) PRODUCT AND METHOD FOR CONCEALING JOINTS

(75) Inventors: Michael C. Colucci, Hillsborough, NJ (US); James W. Nowicki, Hopewell, NJ (US)

(73) Assignee: Henkel AG & Co. KGaA, Duesseldorf (DE)

( * ) Notice: Subject to any disclaimer, the term of this patent is extended or adjusted under 35 U.S.C. 154(b) by 103 days.

(21) Appl. No.: 11/651,435

(22) Filed: Jan. 9, 2007

(65) Prior Publication Data

US 2008/0163584 A1 Jul. 10, 2008

(51) Int. Cl.
*B32B 7/12* (2006.01)

(52) U.S. Cl. ..... 52/417; 52/460; 52/420; 52/459; 428/352; 428/343

(58) Field of Classification Search ..... 52/747.1, 52/288, 417, 460, 420, 459; 428/61, 110, 428/343, 352, 354
See application file for complete search history.

(56) References Cited

U.S. PATENT DOCUMENTS 3,075,853 A * 1/1963 Striker et al. ..... 428/343
3,200,547 A 8/1965 Johnson
3,444,657 A 5/1969 Swanson
5,045,374 A * 9/1991 Tucker ..... 428/83
5,061,559 A * 10/1991 Ogusi et al. ..... 428/343
6,226,946 B1 * 5/2001 Stough et al. ..... 52/417
6,406,782 B2 * 6/2002 Johnson et al. ..... 428/317.7
7,132,142 B2 * 11/2006 Truog et al. ..... 428/40.1
7,141,285 B2 * 11/2006 Bilodeau et al. ..... 428/40.1
2002/0035809 A1 3/2002 Smythe
2004/0053044 A1 * 3/2004 Moreno et al. ..... 428/343
2005/0247011 A1 11/2005 Hansen
2007/0154671 A1 * 7/2007 Shih et al. ..... 428/40.1
2009/0324883 A1 * 12/2009 Gray et al. ..... 428/136

FOREIGN PATENT DOCUMENTS

GB 1284296 8/1972
WO WO 9844218 10/1998

* cited by examiner

*Primary Examiner*—Richard E Chilcot, Jr.
*Assistant Examiner*—Mark R Wendell
(74) *Attorney, Agent, or Firm*—Sun Hee Lehmann

(57) ABSTRACT

Materials and methods are provided to quickly and conveniently conceal drywall seams, corner joints and nail and screw holes or other imperfections in drywall material.

15 Claims, 1 Drawing Sheet

PRODUCT AND METHOD FOR CONCEALING JOINTS

FIELD OF THE INVENTION

Figure 1:
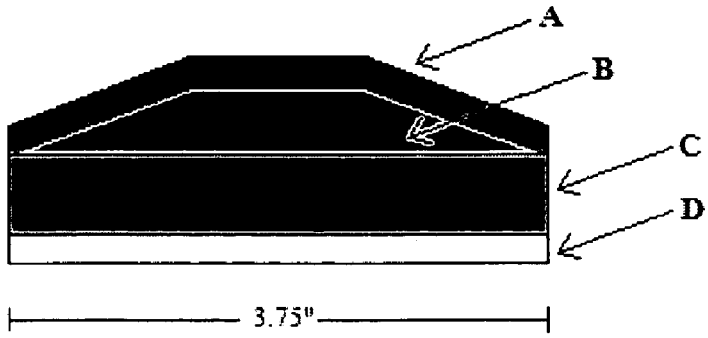
Figure 2:
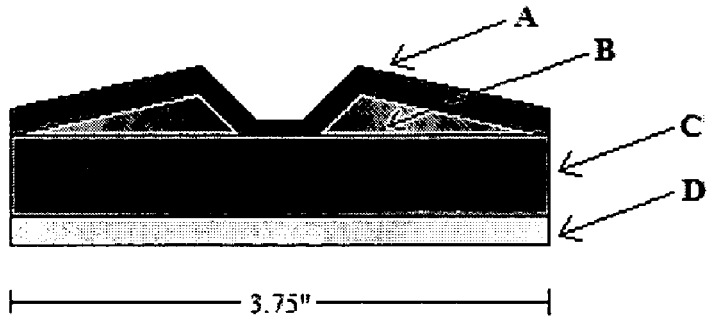
Figure 3:
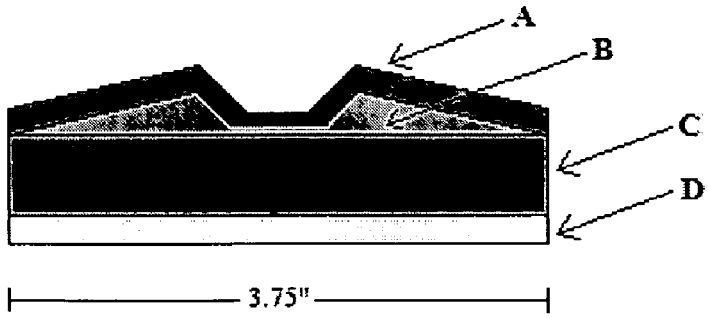

The invention relates to a composite structure that may be used to conceal the joint or seam between adjacent sheets of dry wall.

BACKGROUND OF THE INVENTION

Wallboard sheets are widely used in building construction to form, e.g., the walls and ceilings of rooms and the like. Drywall construction involves applying a plurality of wallboard panels to framing (using screw or nail fasteners) and then concealing the joint or seam between the adjacent board panels. A common method of concealing these joints consists of embedding a narrow paper joint tape over the joint/seam region using an aqueous joint compound, also variously referred to in the art as a cementitious adhesive, drywall mud or spackle. The paper tape provides reinforcing strength to the joint system, preventing cracking of the joint compound along the joint line.

After the joint compound has been allowed to dry for a period of, typically, about one day, a thin layer of the joint compound is applied over the adhered tape, this layer being somewhat wider than the paper tape and which layer is tapered out to very thin edges. This second layer of joint compound is allowed to dry, again typically, for about one day and yet another thin layer of joint compound, somewhat wider than the prior coat, is applied thereover. Typically, the layers are sanded or otherwise smoothed between coatings. In this manner a final substantially monolithic wall surface appearance is provided when the surface is covered with a coating of paint, wall paper or other decorative wall covering.

While this process is generally the way walls and ceilings are constructed, the practice is time consuming (on the order of days) and requires substantial clean-up, both in terms of sweeping- or vacuuming-up the accumulated dust resulting from each sanding and washing the required speckling knifes and mud buckets. This method also requires protective gear, e.g., dust mask, to prevent inhalation of dust particles during sanding operations and clean-up.

There continues to be a need in the art for novel materials and methods that can be used to reduce the amount of time it takes to prepare wall board for final finishing, e.g., painting or the like, reduces the associated mess, and also reduces the costs, in particular labor and clean-up costs. The current invention fulfils this need.

SUMMARY OF THE INVENTION

The invention provides materials and methods used to conceal drywall seams (also referred to herein as manufactured joints, butt joints, or flat joints), corner joints (both inner and outer corners) and fastener (nail and screw) heads, or other imperfections in drywall material.

The present invention provides materials and methods that can be used to quickly and conveniently conceal joints, fastener heads and the like in a single application step by adhering the joint covering material over the joint region without the use of a cementitious adhesive. In the practice of the invention, typically only a single layer of aqueous cementitious adhesive will be required to prepare the joint region for final finishing, i.e., painting.

One embodiment of the invention provides an article that can be used to conceal a joint formed between wall board panels when such panels are erected in edge abutting relationship during the manufacture of simulated monolithic walls and ceilings.

In one preferred aspect of this embodiment the article, also referred to herein as a pressure sensitive adhesive tape, comprises a pressure sensitive adhesive, a flexible reinforcing material and a flexible covering material. In one embodiment, the tape will also comprise a release coating. The flexible reinforcing material will have front side and a back side and a predetermined length, width and thickness and will taper in a lateral direction to thin edge. A pressure sensitive adhesive is present on at least a portion of the back side of the reinforcing material. Present on the front side of the reinforcing material is a flexible covering material. The reinforcing material and covering material will preferably be transparent enough so that accurate positioning of the tape over the seam will be easily accomplished. The front side of the covering will preferably comprise a release coating to allow the tape to be self-wound into a roll.

Another embodiment of the invention provides a method of concealing a dry wall joint comprising positioning the article described herein over a formed joint. The pressure sensitive adhesive tape of the invention is positioned so that the back side of the reinforcing material faces the joint surface. Pressure is then applied to the front side of the tape to cause adhesive layer present on the reinforcing material to stick to and bond to the dry wall, whereby the joint is concealed. Using the method of the invention, the article bonds to the drywall and conceals the joint to provide at least a level 3 equivalent finish.

Due to the adhesive layer and tapered reinforcing material, use of the tape of the invention eliminates the need to apply the first imbed layer of drywall mud and the second filling layer of drywall mud. Elimination of these two layers of mud significantly reduces labor costs and the amount of time required to complete drywall work. For level three finishing no drywall mud is required. For level four finish only a single skim coating of mud is required, with two mud coatings preferred if a level five finish is desired.

In yet another embodiment of the invention, a simulated monolithic wall is prepared by a process in which wall board panels are erected in edge abutting relationship whereby a joint is formed there between. The joint is then covered by positioning the tape over the formed joint such that the back side of the reinforcing material faces the joint surface, and pressure is then applied to said front side of the tape to cause the adhesive to bond to the dry wall and conceal the joint. The joint is thus concealed in a single application step to provide at least a level 3 equivalent finish. A final wall covering finish (e.g., wall paper, paint) may then be applied.

The tape of the invention may be easily cut using a conventional box cutter or utility knife. Conveniently and easily, however, the tape may be cut using to a desired length by a pair of household scissors. Small lengths may be cut, or individually manufactured for use in concealing damaged areas caused by fastener heads (nails and screws).

DETAILED DESCRIPTION OF THE INVENTION

Wallboard sheets generally comprise a gypsum core with outer face layers of paper, and are typically referred to as gypsum board, sheet rock or drywall. Gypsum wallboard is typically manufactured by delivering a slurry or paste containing crushed gypsum rock onto a moving sheet of facing paper to which a second or top paper layer is then added to form a long board line. The board line permits the slurry to harden before being cut. The cut panels are heated in a kiln, before being packaged for storage and shipping. Typically, such sheets are ½ or ⅝ inch thick and in conventional sizes of 4×8 feet, and may weigh from about 55 to about 70 pounds.

The use of aerated concrete as the core material in wallboard sheeting is also known. See, e.g., published International patent WO 00/27866, which describes a wallboard sheet comprising an aerated concrete core covered with outer face layers. Aerated concrete is a steam cured mixture of sand or pulverized fuel ash, cement, lime and an aeration agent. High pressure steam curing in an autoclave produces a physically and chemically stable product with an average density being about one fifth that of normal concrete. The material includes non connecting air cells, and this gives aerated concrete some of it its unique and advantageous properties such as good strength, low weight (a 1 inch thick, 4 foot by 8 foot wallboard sheet typically has a total weight of about 60 pounds), good thermal insulation properties, good sound deadening properties, and has a high resistance to fire.

Both conventional sheet rock and aerated concrete sheets are typically manufactured to have beveled portions adjacent respective opposing side edges, may be readily cut to size by first scoring the face sheet, and then snapping the board about the score line, and may be easily fastened to a suitable building frame using fasteners such as nails and screws.

Whether using conventional gypsum board or other type of wall board, the seams between adjacent wallboards must be covered (i.e., taped and spackled) and fastener heads covered to provide an even wall surface, and then painted or, alternatively, covered with a decorative wall covering. Taping and spackling is extremely time consuming, typically requiring 2, or 3, or more days to obtain an even wall surface suitable for painting or other final finishing.

The extent of wall surface preparation, also referred to as gypsum board finish, is typically described in terms of levels of finish. For example, walls erected in warehouses and other areas where appearance is not critical may require a low level of finish, e.g., just taping and spackling of fastener heads. On the other hand, blemish-free, smooth, monolithic walls and ceilings in homes will require additional finishing prior to application of final decoration. By designating a desired level of finish, the contractor can consider the correct labor and materials required when bidding for a job, and will know how to finish the wall suitable for its desired final decoration. Levels of wall board finish are incorporated into ASTM C 840, "The Standard Specification for Application and Finishing of Gypsum Board." The following levels are used in the art and herein to describe surface finishes.

Level 0—no taping, finishing or accessories (e.g., metal corner bead) required.

Level 1—All joints and interior angles shall have tape set in joint compound. Surface shall be free of excess joint compound. Tool marks and ridges are acceptable.

Level 2—All joints and interior angles shall have tape embedded in joint compound and wiped with a joint knife leaving a thin coating of joint compound over all joint and interior angels. Fastener heads and accessories shall be covered with a coat of joint compound. Surface shall be free of excess joint compound. Tool marks and ridges are acceptable.

Level 3—All joints and interior angles shall have tape embedded in joint compound and one additional coat of joint compound applied over all joints and interior angles. Fastener heads and accessories shall be covered with two separate coats of joint compound. All joint compound shall be smooth and free of tool marks and ridges.

Level 4—All joints and interior angles shall have tape embedded in joint compound and two separate coats of joint compound applied over all flat joints and one separate coat of joint compound applied over interior angles. Fastener heads and accessories shall be covered with three separate coats of joint compound. All joint compound shall be smooth and free tool marks and ridges.

Level 5—All joints and interior angles shall have tape embedded in joint compound and two separate coats of joint compound applied over all flat joints and one separate coat of joint compound applied over interior angles. Fastener heads and accessories shall be covered with three separate coats of joint compound. A thin skim coat of joint compound shall be applied to the entire surface. The surface shall be smooth and free tool marks and ridges.

The present invention provides materials and methods that can be used to quickly and conveniently prepare wall surfaces equivalent to at least a Level 3 or better. Level 3 is typically specified in appearance areas which are to receive heavy- or medium-texture finishes before final painting, or where heavy-grade wall coverings are to be applied as the final decoration. Level 4 is typically designated where flat paints, light textures or wall coverings are to be applied.

The invention provides a system that can be used not only to cover, but to conceal drywall seams, corner joints, fastener heads (nail and screw heads) or other imperfections in drywall material in a single step.

The product of the invention (also alternatively referred to herein as a construct or a tape) is directed to a flexible pressure sensitive tape that is thick in the center and tapered thin to the edge.

Due to the adhesive layer and tapered plastic profile, this tape eliminates the need to apply the first imbed layer of drywall mud, and second filling layer of drywall mud. Elimination of these two layers of mud significantly reduces the labor costs and time required to complete drywall work. For level three finishing no drywall mud is required. For level four finish only a single skim coating of mud is required, with tow mud coatings preferred if a level five finish is desired.

The tape is deliberately designed to be flexible so that it is easily rolled and un-rolled. Furthermore, the tape is made from materials that are soft and flexible so that the tape can be easily cut, e.g., with a pair of scissors, and conform to the shape of the wall surface. The covering material layer is preferably either translucent or transparent so that the practitioner can visually see the edge to be covered to enable easy alignment of the tape with the joint. The film must also be compatible with drywall mud so that it has good adhesion to the mud. In one preferred embodiment, glassine film has been found to exhibit desirable properties of strength, flexibility, easy cutting, translucence, compatibility with drywall mud, and cost.

A release coating is placed on the back surface of the film so that the tape can be self-wound into a roll. This eliminates the need for a release liner or paper, and allows the tape to be transported and dispensed quickly with little effort.

The tape is suitable for joints made from factory finished edges of drywall board, and also cut to cut joints or cut to factory finished joints. Modifications of the profile have been found to be more suitable for inside and outside corner joints of drywall. For corners the profile is modified by scoring a groove down the center of the profile. This groove enables the worker to easily fold the profiled tape for attachment into drywall corners.

The system of the invention eliminates the need for the initial application of cementious adhesive conventionally used to bond the tape to the sheetrock and the drying time associated therewith and also eliminates the need for applying and sanding multiply coating or concealing layers of cementious adhesive prior to painting or hanging of a wall covering/ wall paper. Use of the system of the invention dramatically reduces the time from start to finish, with generally only a single coat, perhaps two, being required to achieve a desired result.

The invention provides a composite, also referred to herein as an article, product or tape, that is used to bond together sheets of drywall and conceal the joint there between. The article of the invention, and components thereof have a predetermined width, length and thickness.

By "predetermined" width, length and thickness means that the article can be manufactured in various dimensions as required or desired for, e.g., performance, manufacture, marketing, end uses, etc. Use of the term "predetermined" profile is likewise used to mean that the profile is chosen as required or desired.

The composite comprises a reinforcing substrate having a front side and a back side, an adhesive present on at least a portion of the back side of the reinforcing substrate, a cover material having a front side and a back, the back side of the cover material facing the front side of the reinforcing material, and a release coating present on the front side of the cover material a, and a heat resistant release liner having a front side and a back side.

Front side is used herein to refer to the surface of the article or component thereof facing the interior of the room when the article is placed in parallel juxtaposition to the wall or ceiling surface.

Back side is used herein to refer to the surface of the article or component thereof facing the wall or ceiling of the room when the article is placed in parallel juxtaposition to the wall or ceiling surface.

The pressure sensitive adhesive tape comprises a pressure sensitive adhesive, a flexible reinforcing material and a flexible covering material. In one embodiment, the tape will also comprise a release coating. The flexible reinforcing material will have a front side and a back side and a predetermined length, width and thickness and will taper in a lateral direction to a thin edge. A pressure sensitive adhesive is present on at least a portion of the back side of the reinforcing material. Present on the front side of the reinforcing material is a flexible covering material. The reinforcing material and covering material will preferably be transparent enough so that accurate positioning of the tape over the seam will be easily accomplished. The front side of the covering material will preferably comprise a release coating to allow the tape to be self-wound into a roll.

The reinforcing material will be thick in the center and tapered thin along the edges. Examples of reinforcing materials include paper tapes and perforated fiber tapes, such as fiberglass mesh. Flexible plastic is one particularly preferred embodiment. A pressure sensitive adhesive is present on at least a back side of the reinforcing material. The term "pressure-sensitive adhesive" is used herein to refer to a viscoelastic material which adheres instantaneously to most substrates with the application of at least slight pressure and remains permanently tacky. Any adhesive that exhibits residual tack may be used. Included are hot melt adhesives, acrylic solution adhesives, waterborne adhesives and the like. Any pressure sensitive adhesive may be used in the practice of the invention as long as it is capable of at least temporarily securing the reinforcing material to the surface of the dry wall.

A pressure sensitive adhesive is present on at least a back side of the reinforcing material. The term "pressure-sensitive adhesive" is used herein to refer to a viscoelastic material which adheres instantaneously to most substrates with the application of at least slight pressure and remains permanently tacky. Any adhesive that exhibits residual tack may be used. Included are hot melt adhesives, acrylic solution adhesives, UV curable adhesives, and waterborne adhesives. Any pressure sensitive adhesive may be used in the practice of the invention as long as it is capable of at least temporarily securing the reinforcing material to the surface of the dry wall.

Present on the front side of the reinforcing material is a flexible covering material. The reinforcing material and covering material will preferably be transparent enough so that accurate positioning of the tape over the seam will be easily accomplished. The front side of the covering will preferably comprise a release coating to allow the tape to be self-wound into a roll.

Examples of suitable covering materials include paper, cellophane, nylon, glassine paper, clay and kraft paper, polyethylene films, silicones, and polyethylene film. In one preferred embodiment, the covering material is glassine.

If required for purpose of adequate release, the front side of the covering material will comprise a release coating. Release coatings are known in the art. Examples include silicone coatings and polytetrafluoroethylene (TEFLON).

The invention also provides a method of concealing a dry wall joint comprising positioning the herein described article of the invention over a formed joint. The article is positioned so the back side of the reinforcing material faces the joint surface. Sufficient pressure and is applied to front side of the release liner to cause the reinforcing material to bond to the dry wall and cover the joint.

It is a further object of the invention to provide a simulated monolithic wall comprising wall board panels erected in edge abutting relationship whereby a joint is formed there between, and then concealing the joints by this method of the invention. Simulated monolithic wall can be prepared by erecting wall board panels in edge abutting relationship whereby a joint is formed there between, concealing the joint by positioning the pressure sensitive tape of the invention over a formed joint, applying pressure and to cause the tape to remain adhered and then optionally if desired applying at least one, more typically two coats, of a cementious adhesive thereover in order to further, if desired, conceal the joint. The concealed joint wall may then have applied thereon a wall covering finish such as, for example, flat paint to fully conceal the joint and affect a finished appearance.

For use in the practice of several aspects of this invention, the width of the pressure sensitive tape will typically range from about 2 inches to about 5 inches or more, more typically embodiments will have width of from about 3 inches to about 4 inches. Tapes may be manufactured in any desired or convenient length. Rolls containing 20 to 50 yards or more can be conveniently manufactured. The films can also be manufactures in varying lengths such as 2, four six eight feet or the like.

In one embodiment, the pressure sensitive tape is adapted for use to cover/conceal inside or outside corner joints of any desired angle, e.g., 90°, 45°. The profile for a tape to be used on corners is modified by scoring a groove down the center of the profile. This groove enables the worker to easily fold the profiled tape for attachment into drywall corners.

In one embodiment the tape will have a profile that is thinner (approaching 0.001 inch) on the edges of the profile and thicker (approaching 0.070 inch) in the center, and be preferably about 3 to 4 inches wide. This embodiment is most useful when covering manufactured joints.

The joint systems formed in accordance with the invention are capable of being finally finished in a significantly shorter period of time than is required for those made with prior known methods. The method of the invention allows the formation of drywall joint systems of high quality in significantly shorter periods of time than were necessary with the prior known method thus enabling those engaged in the field of simulated monolithic wall construction to achieve substantial economies.

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

The invention claimed is:

1. A pressure sensitive adhesive tape comprising a reinforcing material having a front and a back side and a covering material having a front and a back side, wherein said front side of the reinforcing material faces the back side of the covering material, at least a portion of the front side of the covering material has a release coating applied thereon and at least a portion of the back side of the reinforcing material has coated thereon a pressure sensitive adhesive, wherein the reinforcing material is a flexible plastic selected from the group consisting of polycarbonate, polyester, polyimide, polysulfone polyether sulfone, polystyrene, polyolefin, polyvinyl alcohol, cellulose acetate, polyvinyl chloride, polyacrylate and polymethyl methacrylate polymer, and the pressure sensitive adhesive tape is effective to achieve a Level 3 or better wall finish according to ASTM C840 without the use of a cementitious adhesive.

2. The tape of claim 1 wherein the reinforcing material is tapered laterally to a thin edge.

3. The tape of claim 2 wherein the covering material is paper.

4. The tape of claim 3 wherein the covering material is glassine.

5. The tape of claim 4 wherein the tape is substantially transparent.

6. The tape of claim 1 wherein the reinforcing material has a groove located in the center of the tape.

7. A method of concealing a dry wall joint comprising positioning the tape of claim 1 over a formed joint such that the pressure sensitive tape present on the reinforcing material of said tape faces the joint, and applying pressure to cause the tape to adhere to the dry wall, wherein said tape adheres to the dry wall without the use of, and without being imbedded in, a layer of a cementitious adhesive, and wherein the reinforcing material is a flexible plastic.

8. The method of claim 1 wherein the formed joint is a corner joint.

9. The method of claim 1 wherein the corner joint is an inside corner.

10. The method of claim 1 wherein the corner joint is an outside corner.

11. The method of claim 7 wherein said tape conceals the joint to at least a level 3 equivalent finish.

12. The method of claim 7 wherein the tape comprises a paper covering material.

13. The method of claim 12 wherein the covering material is glassine.

14. A simulated monolithic wall prepared by the process comprising erecting wall board panels in edge abutting relationship whereby a joint is formed there between, positioning the tape of claim 1 over a formed joint such that the pressure sensitive tape present on the reinforcing material of said tape faces the joint, wherein the covering material is glassine applying pressure to cause the tape to adhere to the dry wall, wherein said tape adheres to the dry without the use of, and without being imbedded in, a layer of a cementitious adhesive, disposing over the adhered tape at least one layer of an aqueous cementitious adhesive and applying a wall covering finish.

15. The wall of claim 14 wherein the tape is substantially transparent.

* * * * *